US011566864B2

(12) United States Patent
Nevels et al.

(10) Patent No.: US 11,566,864 B2
(45) Date of Patent: Jan. 31, 2023

(54) ARCHERY BOW WITH CABLE SPLITTER

(71) Applicant: Precision Shooting Equipment, Inc., Tucson, AZ (US)

(72) Inventors: Samuel S. Nevels, Marana, AZ (US); Kevin L. Hansen, Jefferson City, MT (US)

(73) Assignee: Precision Shooting Equipment, Inc., Tucson, AZ (US)

( * ) Notice: Subject to any disclaimer, the term of this patent is extended or adjusted under 35 U.S.C. 154(b) by 0 days.

(21) Appl. No.: 17/505,852

(22) Filed: Oct. 20, 2021

(65) Prior Publication Data

US 2022/0120530 A1 Apr. 21, 2022

Related U.S. Application Data

(60) Provisional application No. 63/094,144, filed on Oct. 20, 2020.

(51) Int. Cl.
*F41B 5/10* (2006.01)
*F41B 5/14* (2006.01)

(52) U.S. Cl.
CPC ..... *F41B 5/1403* (2013.01); *F41B 5/10* (2013.01); *F41B 5/105* (2013.01)

(58) Field of Classification Search
CPC ..... F41B 5/10
See application file for complete search history.

(56) References Cited

U.S. PATENT DOCUMENTS 4,440,142 A * 4/1984 Simonds ..... F41B 5/10 124/90
4,546,754 A * 10/1985 Smith ..... F41B 5/10 124/25.6
4,733,648 A * 3/1988 Martin ..... F41B 5/10 24/135 N
4,781,167 A * 11/1988 Martin ..... F41B 5/10 124/90
5,381,777 A * 1/1995 Mitchell ..... F41B 5/10 124/90
5,606,963 A * 3/1997 Wenzel ..... F41B 5/10 124/25.6
5,809,984 A * 9/1998 Johnson ..... F41B 5/105 124/25.6
6,729,320 B1 * 5/2004 Terry ..... F41B 5/10 124/25.6
8,037,876 B1 * 10/2011 Yehle ..... F41B 5/10 124/25.6
8,443,791 B2 * 5/2013 Miller ..... F41B 5/105 124/25.6
8,662,062 B2 * 3/2014 Darlington ..... F41B 5/123 124/900
2016/0216058 A1 * 7/2016 Sidebottom ..... F41B 5/14
2017/0370673 A1 * 12/2017 Yehle ..... F41B 5/10

* cited by examiner

*Primary Examiner* — John A Ricci
(74) *Attorney, Agent, or Firm* — Merchant & Gould P.C.

(57) ABSTRACT

A bow (e.g., compound bow, cross bow, etc.) that includes a cable splitter. The cable splitter is easy to install in that it does not require access to the yoke ends of the bow string. The cable splitter is self-anchoring to the cable. In addition, the cable splitter eliminates the need for a separate saddle and separate section of cable. The cable splitter also allows for tuning for cam lean by adding or removing twist in the yoke ends.

16 Claims, 12 Drawing Sheets

ARCHERY BOW WITH CABLE SPLITTER

CROSS-REFERENCE TO RELATED APPLICATIONS

This application claims priority to U.S. Provisional Application Ser. No. 63/094,144, filed on Oct. 20, 2020, the entire disclosure of which is hereby expressly incorporated herein by reference.

BACKGROUND

Modern archery typically involves the shooting of bows that include cam systems that enable the bow string to be held back at full draw with less force than is required to pull back the bow string. This feature known as "let off" is a desirable feature for hunting and general shooting as it enables the shooter to maintain full draw for a relatively long period of time. The cam systems typically include one or more cables that are connected between cams and/or idler wheels supported at the opposite end of the limbs of the bow. To provide an unobstructed path for the arrow flight from the bow, a cable guard is often used to bias the cables out of the bow string plane. A side effect of this cable guard, as well as the varying forces and leverages that the bow string and cables impart on the cams as they rotate, can result in twisting forces and deflection of the cams commonly referred to as "cam lean." Excessive cam lean is undesirable. One way to minimize cam lean is to configure the bow such that the cables apply a generally balanced force on the cam. In some systems, the cable terminates at a saddle component that is generally centered over the cam and a separate cable connects the saddle to opposed sides of the cam.

SUMMARY

The present disclosure provides a bow (e.g., compound bow, cross bow, etc.) that includes a cable splitter. The cable splitter of the depicted embodiment is easy to install in that it does not require access to the yoke ends of the bow string. The cable splitter of the depicted embodiment is self-anchoring to the cable. In addition, the cable splitter of the preferred embodiment eliminates the need for a separate saddle and separate section of cable. The cable splitter of the present disclosure also allows for tuning for cam lean by adding or removing twist in the yoke ends.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
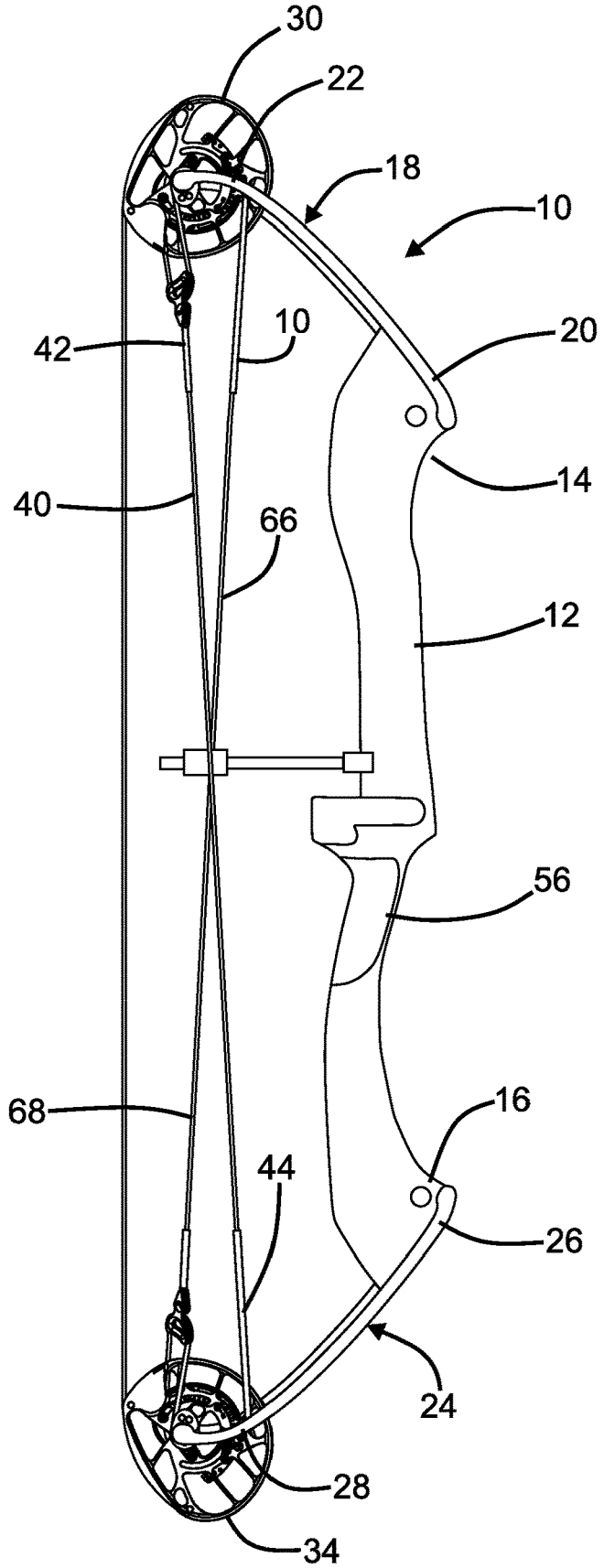
FIG. 1 is an isometric view of the bow of the present disclosure.
Figure 2:
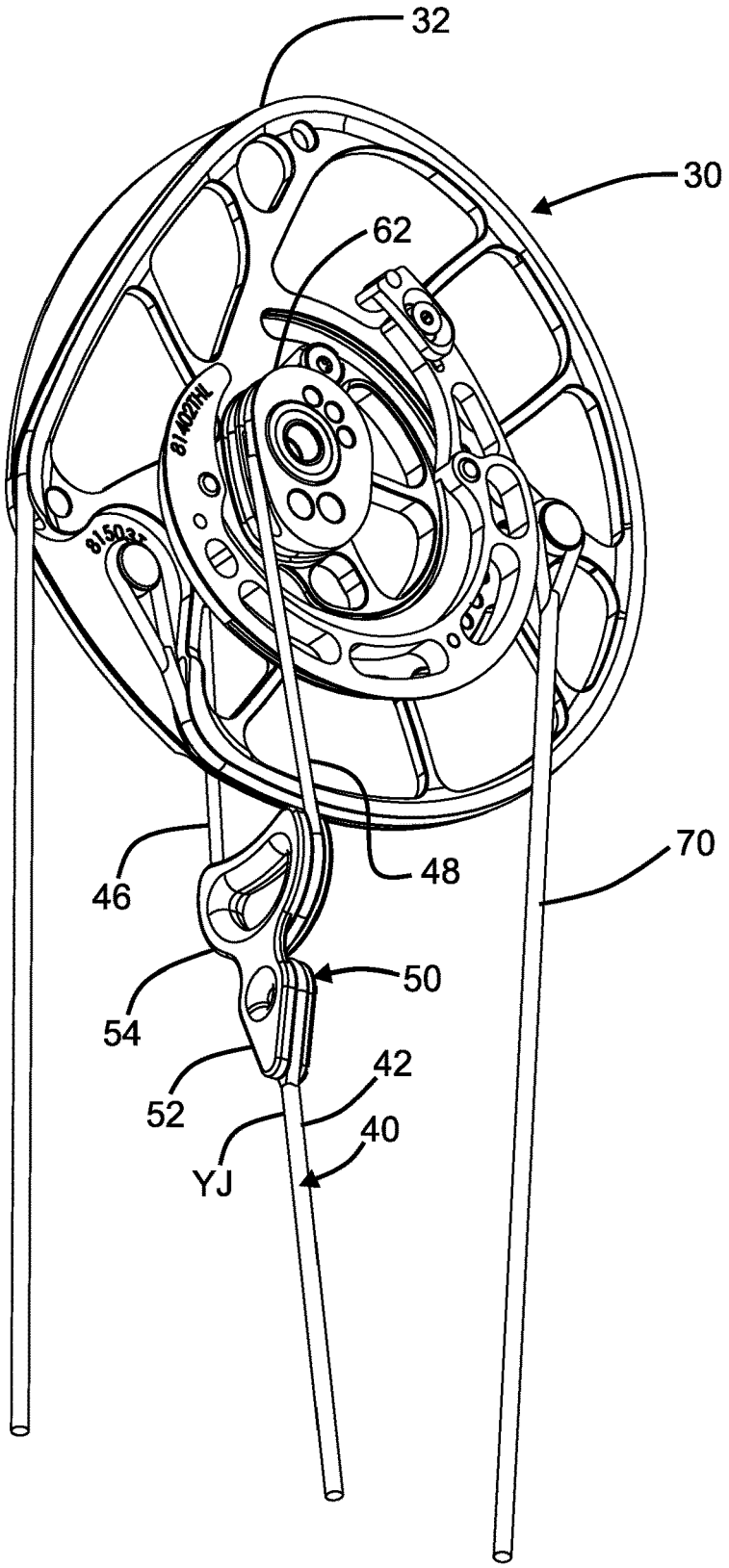
FIG. 2 is a first isometric view of an enlarged portion of the bow of FIG. 1 with parts removed for clarity.
Figure 3:
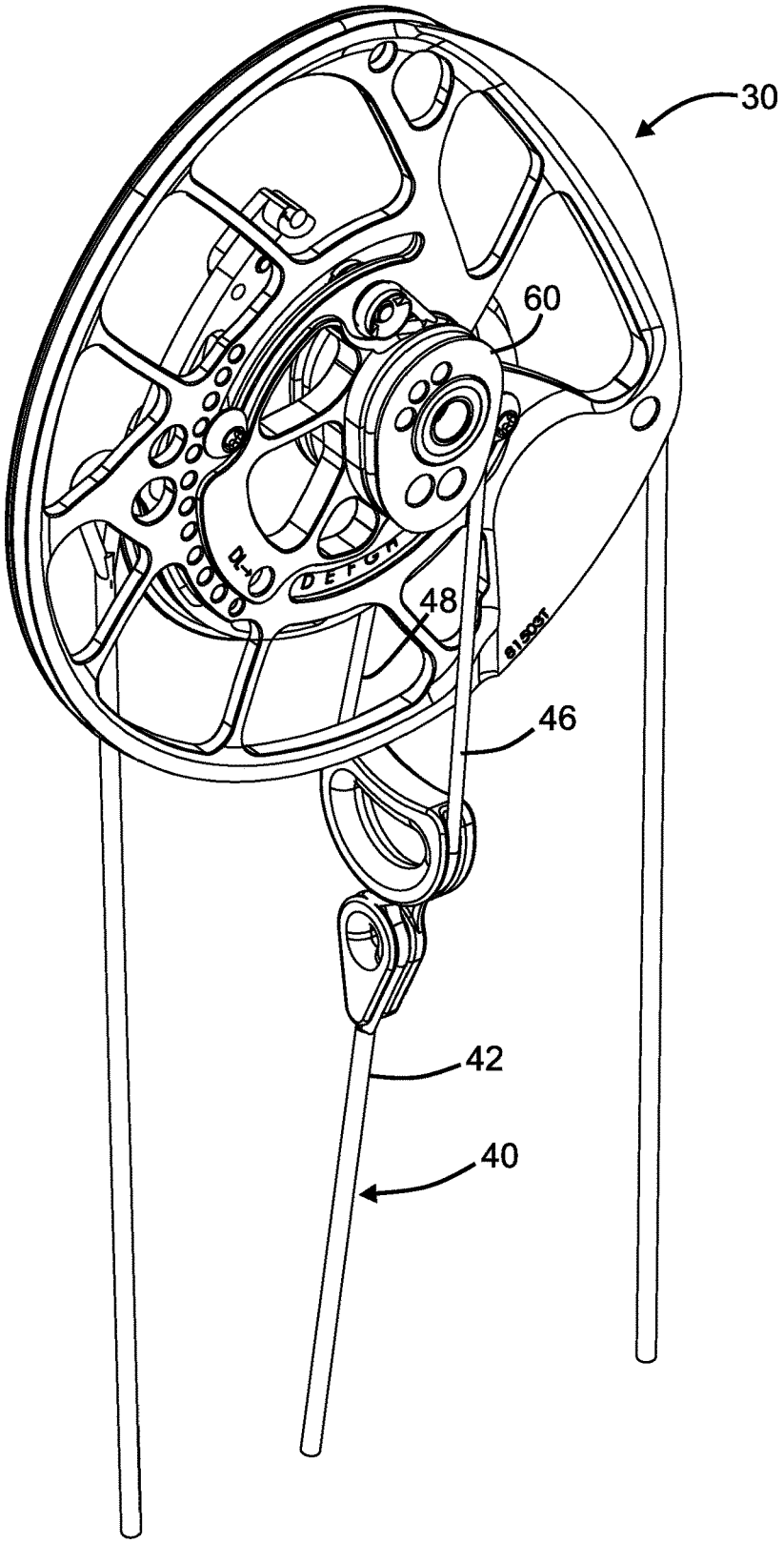
FIG. 3 is a second isometric view of a portion of the bow of FIG. 1 with parts removed for clarity.
Figure 4:
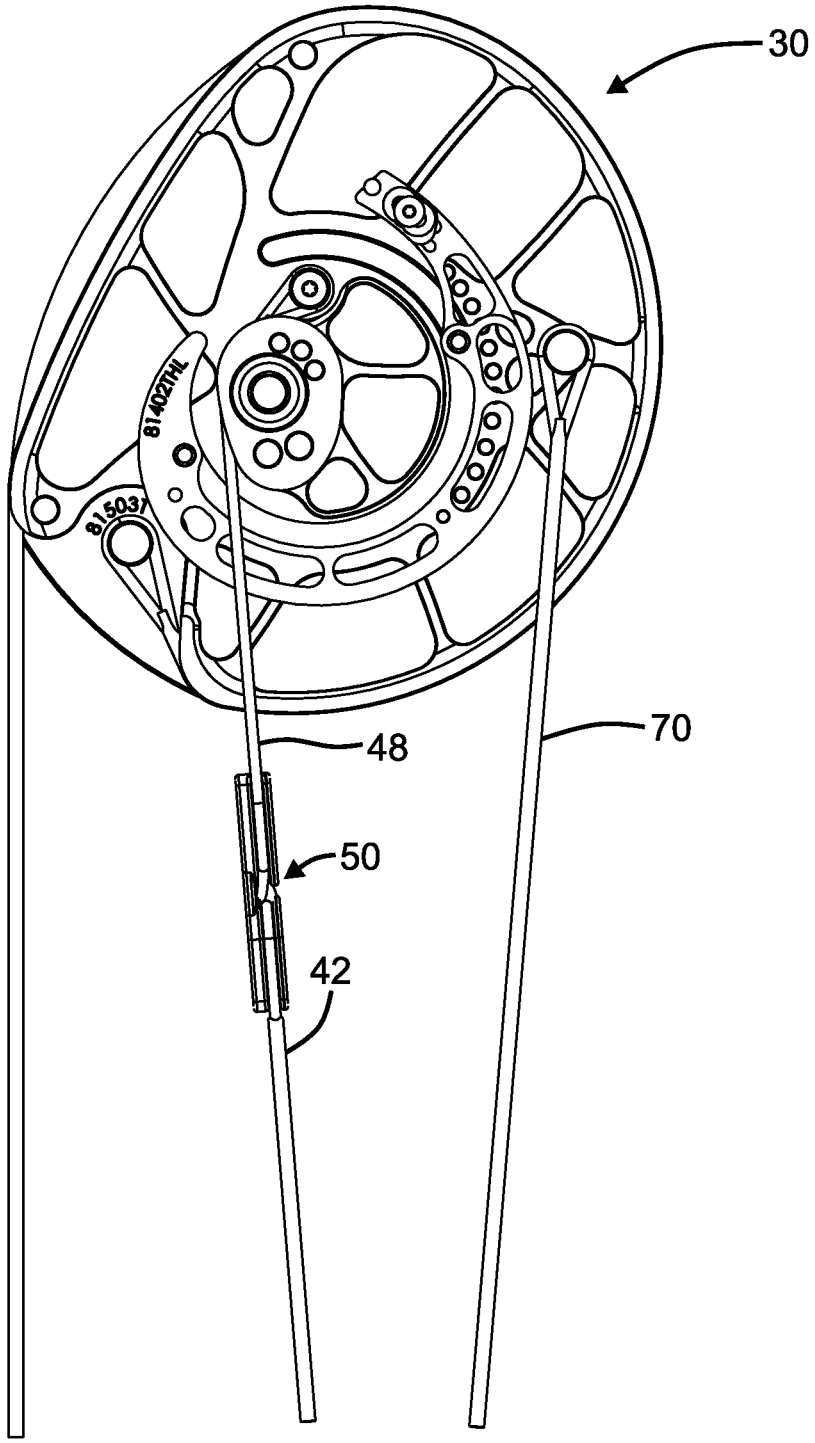
FIG. 4 is a first side view of a portion of the bow of FIG. 1 with parts removed for clarity.
Figure 5:
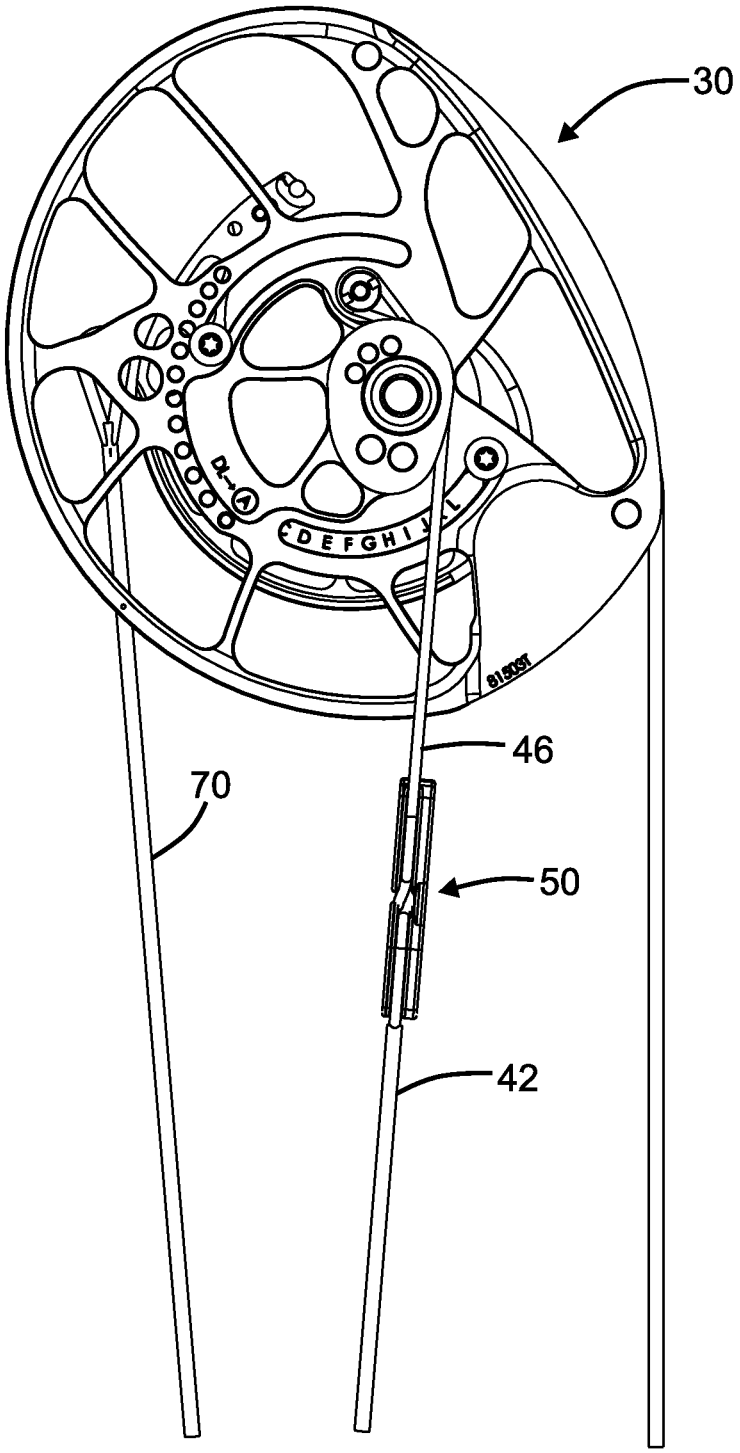
FIG. 5 is a second side view of a portion of the bow of FIG. 1 with parts removed for clarity.
Figure 6:
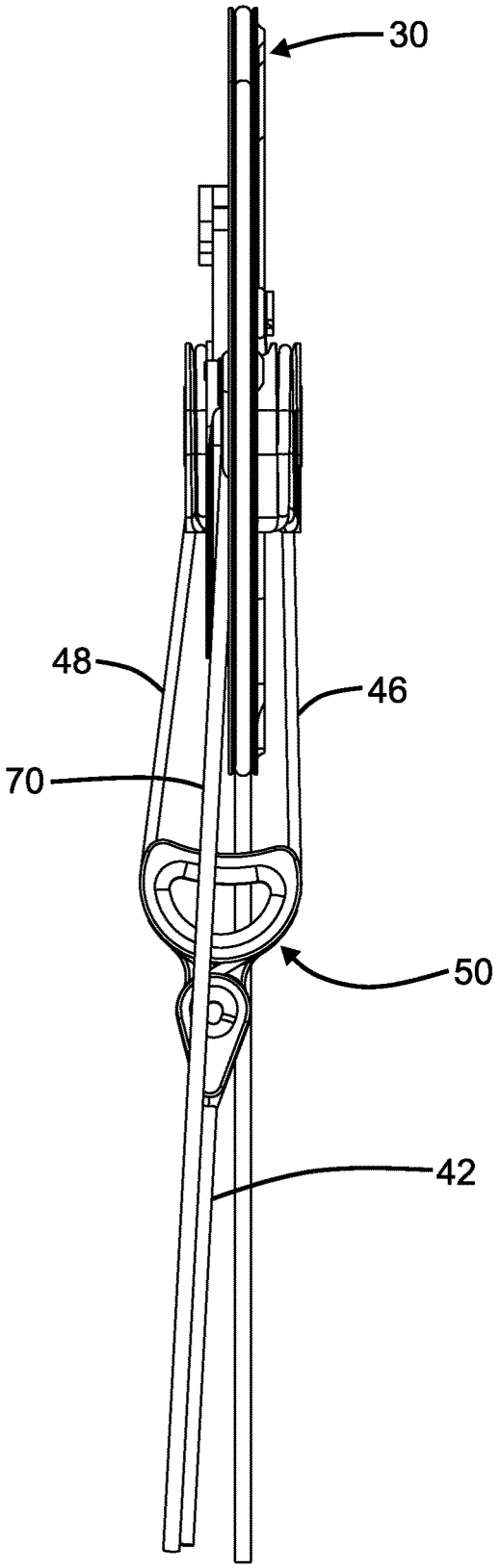
FIG. 6 is an end view of a portion of the bow of FIG. 1 with parts removed for clarity.
Figure 7:
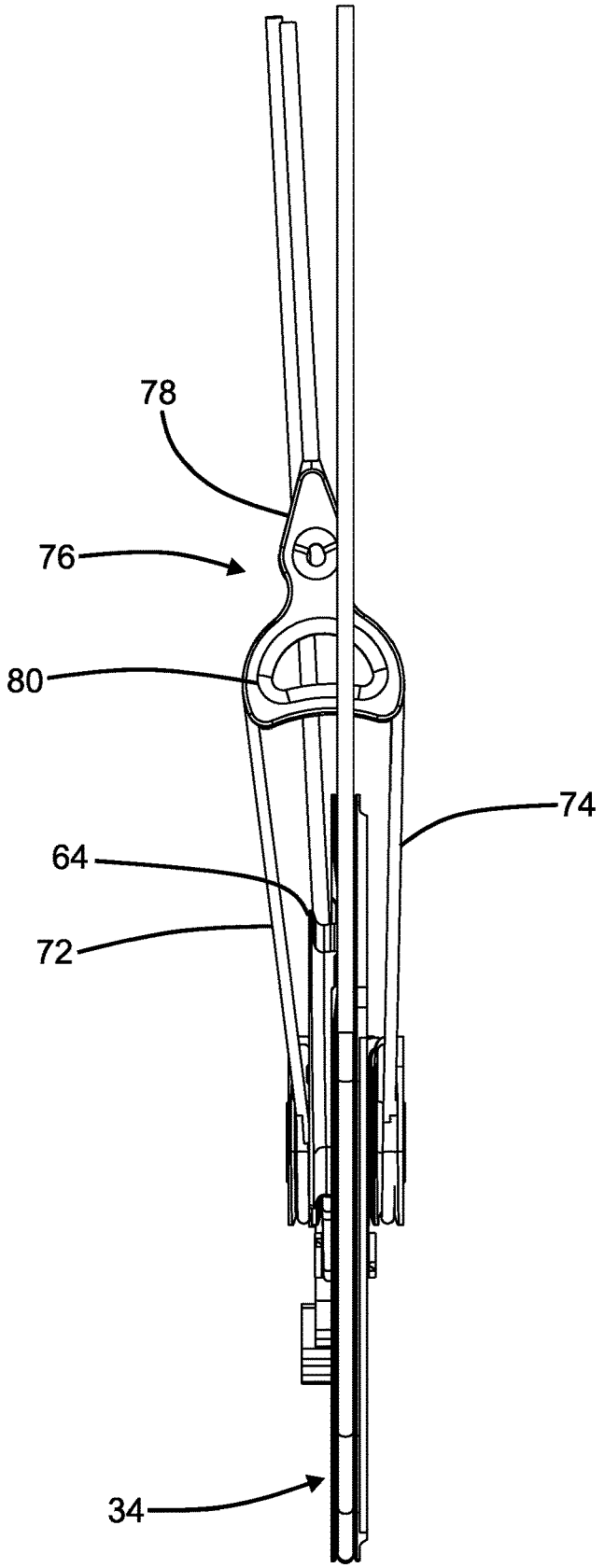
FIG. 7 is an end view of a portion of the bow of FIG. 1 with parts removed for clarity.
Figure 8:
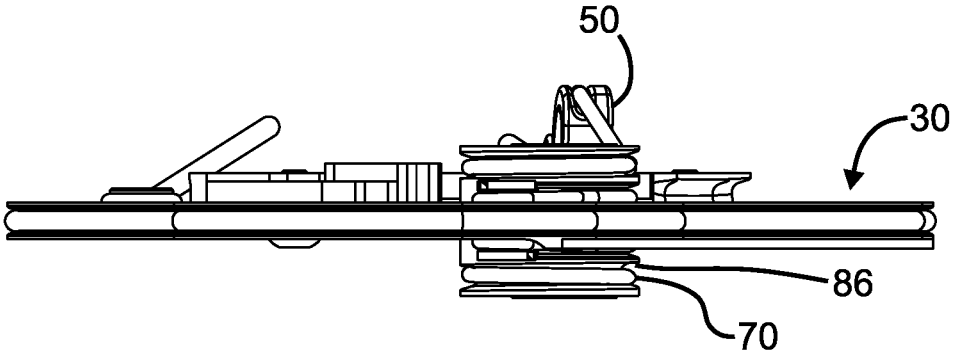
FIG. 8 is a bottom view of a portion of the bow of FIG. 1 with parts removed for clarity.
Figure 9:
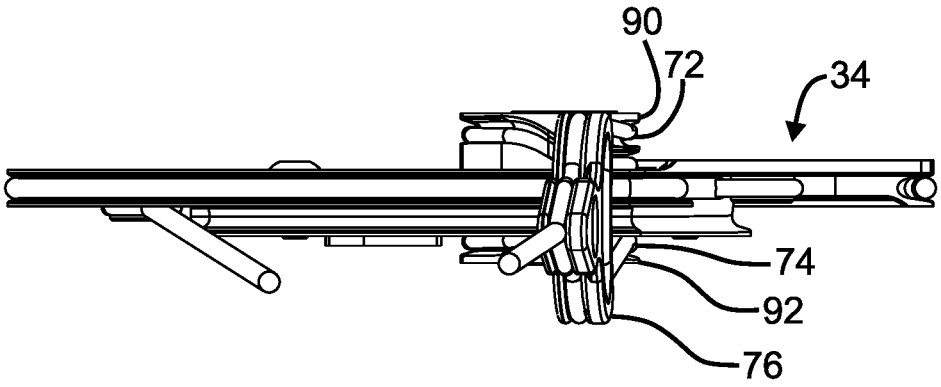
FIG. 9 is a top view of a portion of the bow of FIG. 1 with parts removed for clarity.
Figure 10:
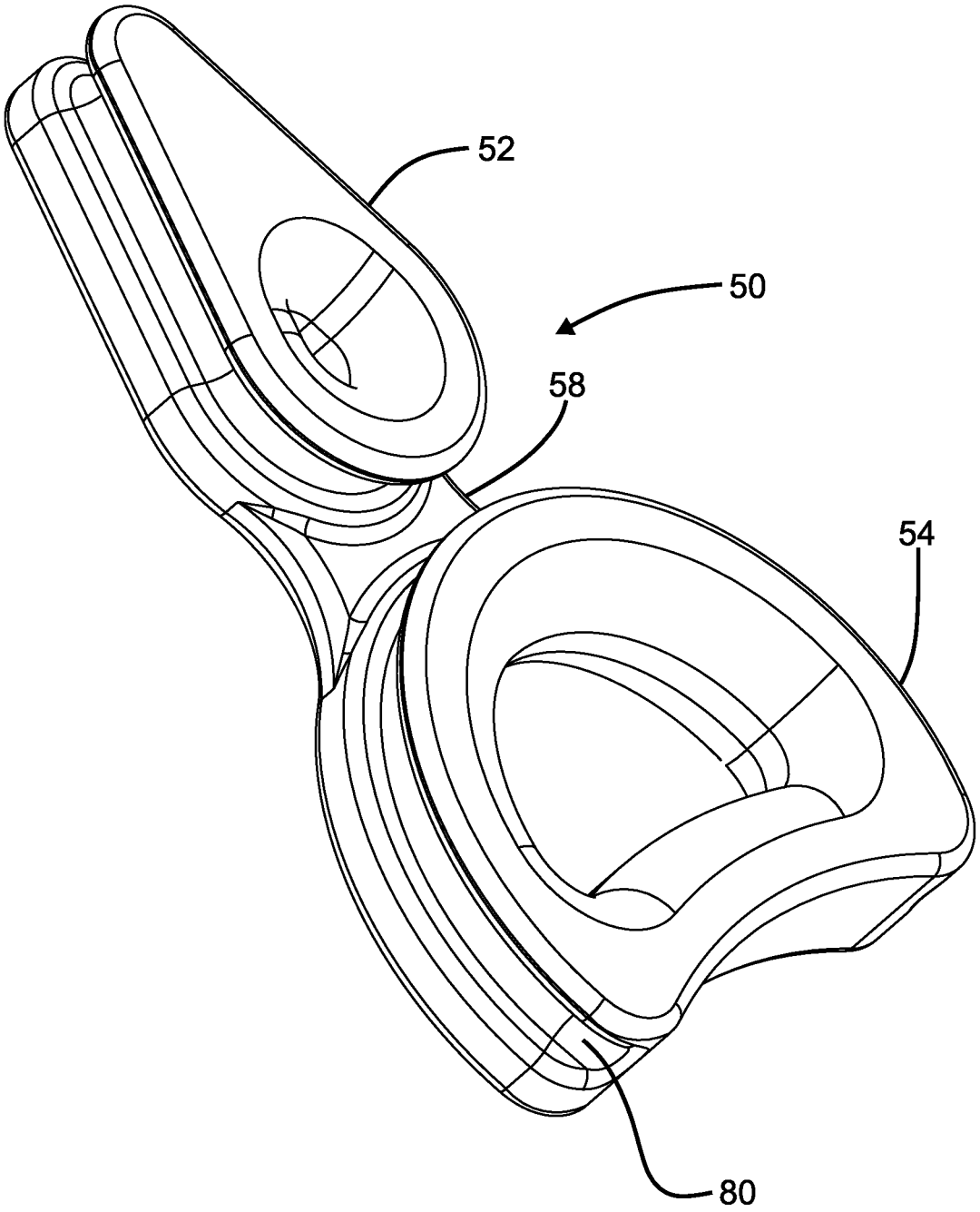
FIG. 10 is a front isometric view of the cable splitter of the bow of FIG. 1.
Figure 11:
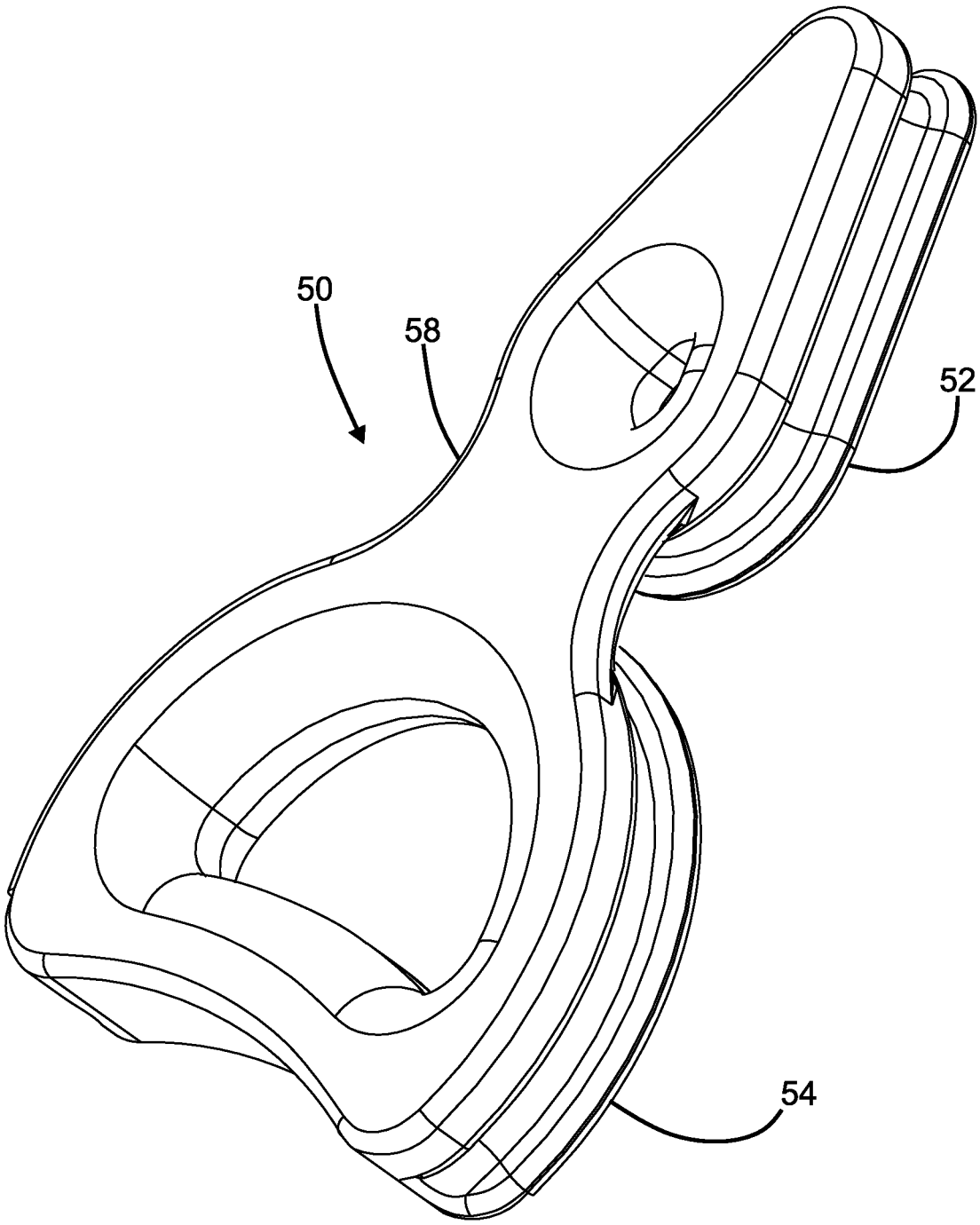
FIG. 11 is a rear isometric view of the cable splitter of the bow of FIG. 1.
Figure 12:
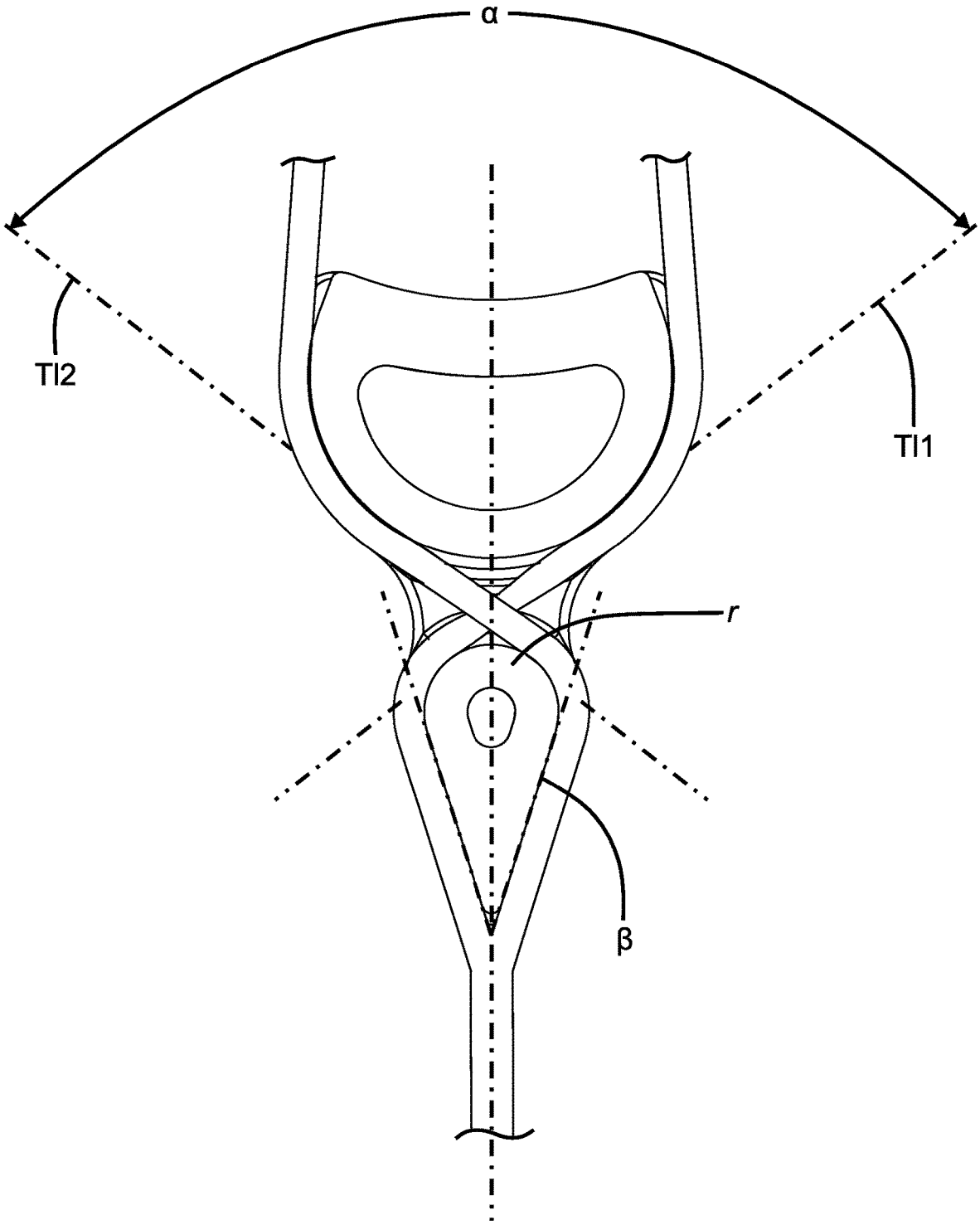
FIG. 12 is a front view of the cable splitter of the bow of FIG. 1.
Figure 13:
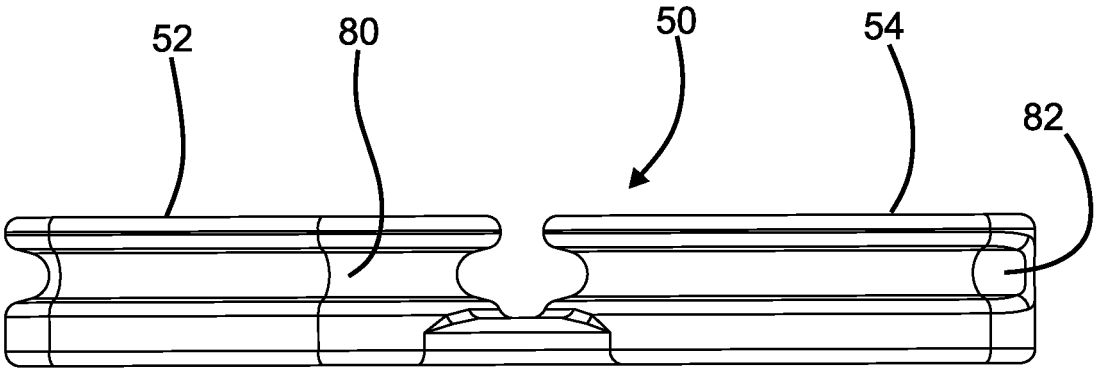
FIG. 13 is a side view of the cable splitter of the bow of FIG. 1.

Referring to the figures, the bow 10 of the present disclosure is described in further detail. In the depicted embodiment, the bow 10 is a compound bow; however, it should be appreciated that it can be a different type of bow including, for example, a crossbow.

The bow 10 of the depicted embodiment includes a riser 12 that includes a first end 14 and a second end 16. In the depicted embodiment, the riser 12 includes a handle 56. It should be appreciated that other configurations are also possible.

In the depicted embodiment, the bow 10 includes a first limb assembly 18 that includes a first end 20 and a second end 22. The first end 20 of the first limb assembly 18 is connected to the first end 14 of the riser 12. In the depicted embodiment, the bow 10 includes a second limb assembly 24 that includes a first end 26 and a second end 28. The first end 26 of the second limb assembly 24 is connected to the second end 16 of the riser 12. In the depicted embodiment, each limb assembly 18, 24 includes a pair of limb members. However, it should be appreciated that many other alternative configurations are possible.

In the depicted embodiment, the bow 10 includes a first rotating body 30 connected to the second end 22 of the first limb assembly 18. The first rotating body 30 includes a first bow string track 32. In the depicted embodiment, the first bow string track 32 is non-concentric. In the depicted embodiment, the bow 10 includes a second rotating body 34 connected to the second end 28 of the second limb assembly 24. The second rotating body 34 includes a second bow string track 36. In the depicted embodiment, the bow 10 includes a bow string 38 connected between the first bow string track 32 and the second bow string track 36. In the depicted embodiment, each of the rotating bodies 30, 34 are cams. It should be appreciated that many other alternative configurations are possible.

In the depicted embodiment, the first cable 40 includes a first end 42 and a second end 44. The first end 42 splits into a first yoke end 46 and a second yoke end 48. The first yoke end 46 and the second yoke end 48 are connected to the first rotating body 30 on a first and a second side of the first bow string track 32. In the depicted embodiment, the first yoke end 46 and the second yoke end 48 of the first cable 40 are configured to engage a first yoke track 60 and a second yoke track 62 on the first rotating body 30. In the depicted embodiment, the first and second yoke tracks 60, 62 are non-concentric. In the depicted embodiment, the second end 44 of the first cable 40 is connected to the second rotating body 34. The second end 44 of the first cable 40 is configured to engage a first cable track 64 on the second rotating body 34. In the depicted embodiment, the first cable track 64 is non-concentric. It should be appreciated that many other alternative configurations are possible.

In the depicted embodiment, the bow 10 includes a first cable splitter 50. The first cable splitter 50 includes an anchor head portion 52 and a spreader body portion 54. Both the anchor head portion 52 and the spreader body portion 54 are engaged between the first yoke end 46 and the second yoke end 48 of the first cable 40. In the depicted embodiment, the anchor head portion 52 has a teardrop shaped periphery edge profile. In the depicted embodiment, the periphery edge of the anchor head portion 52 includes a periphery groove 80 in a first plane. In the depicted embodiment, the radius of curvature of the anchor periphery groove 80 at the pointed end opposite the spreader body portion 54 is between 0.005 and 0.100 inches. In the depicted embodiment, the radius of curvature (r) defined by the base of the teardrop profile adjacent the spreader body portion 54 is between 0.10 and 0.4 inches, and more preferably, between 0.125 and 0.25 inches. The first yoke end 46 and the second yoke end 48 are seated in the periphery groove 80. In the depicted embodiment, the anchor head portion 52 includes a tapered end portion 84 that includes a wedge angle $\beta$ of between 25 and 45 degrees. It should be appreciated that many other alternative configurations are possible.

In the depicted embodiment, the spreader body portion 54 includes a U-shaped periphery edge profile. The U-shaped periphery edge of the spreader body portion 54 includes a spreader periphery groove 82 in a second plane. In the depicted embodiment, the second plane is coincident with the first plane. In the depicted embodiment, the anchor head portion 52 and the spreader body portion 54 are configured such that a tangent line TL1 that extends from a first side of the anchor periphery groove 80 to the second side of the spreader periphery groove 82 intersects with a tangent line TL2 that extends from a second side of the anchor periphery groove 80 to the first side of the spreader periphery grove 82. The angle of intersection referred to herein as the yoke transition angle $\alpha$ is between 90 and 120 degrees. It should be appreciated that many other alternative configurations are possible.

In the depicted embodiment, the first cable splitter 50 includes a neck portion 58 that connects the anchor head portion 52 and the spreader body portion 54, wherein the neck portion 58 defines a yoke receiving gap between the anchor head portion 52 and the spreader body portion 54. In the depicted embodiment, the first yoke end 46 and the second yoke end 48 cross over each other at the neck portion 58. It should be appreciated that many other alternative configurations are possible.

In the depicted embodiment, the bow 10 includes a second cable 66. The second cable 66 includes a first end 68 and a second end 70. The first end 68 is split into a first yoke end 72 and a second yoke end 74. The first and second yoke ends 72, 74 are connected to the second rotating body 34 on a first and a second side of the second bow string track 36. It should be appreciated that many other alternative configurations are possible.

In the depicted embodiment, the bow 10 includes a second cable splitter 76 including an anchor head portion 78 and a spreader body portion 88 engaged between the first yoke end 72 and the second yoke end 74 of the second cable 66. In the depicted embodiment, the first yoke end 72 and the second yoke end 74 of the second cable 66 are configured to engage the first and second yoke tracks 90, 92 on the second rotating body 34. In the depicted embodiment, the first and second yoke tracks 90, 92 are non-concentric. In the depicted embodiment, the second end 70 of the second cable 66 is connected to the first rotating body 30. In the depicted embodiment, the second end 70 of the second cable 66 is configured to engage a second cable track 86 on the first rotating body 30. In the depicted embodiment, the second cable track 86 is non-concentric. It should be appreciated that many other alternative configurations are possible.

In the depicted embodiment, the first cable 40 includes a plurality of strands encased in a serving. The serving terminates at a yoke junction YJ at which the first and second yoke ends 46, 48 split. In the depicted embodiment, the anchor head portion 52 is driven against the split junction SJ. It should be appreciated that many other alternative configurations are possible.

In the depicted embodiment, the cam lean can be further adjusted or tuned by shortening or lengthening the yoke ends. One method of quickly and easily shortening a yoke end is to twist the yoke end about the axis of the yoke.

In the depicted embodiment, the anchor head portion 52 includes a through aperture therein and the spreader body portion 54 also includes a through aperture therein. These apertures can be used as a tie in point for a fall way arrow rest. It should be appreciated that many other alternative configurations are possible.

The description and illustration of one or more embodiments provided in this application are not intended to limit or restrict the scope of the invention as claimed in any way. The embodiments, examples, and details provided in this application are considered sufficient to convey possession and enable others to make and use the best mode of the claimed invention. The claimed invention should not be construed as being limited to any embodiment, example, or detail provided in this application. Regardless of whether shown and described in combination or separately, the various features (both structural and methodological) are intended to be selectively included or omitted to produce an embodiment with a particular set of features. Having been provided with the description and illustration of the present application, one skilled in the art may envision variations, modifications, and alternate embodiments falling within the spirit of the broader aspects of the claimed invention and the general inventive concept embodied in this application that do not depart from the broader scope.

What is claimed is:

1. A bow comprising:

a riser including a first end and a second end;

a first limb assembly including a first end and a second end, the first end of the first limb assembly is connected to the first end of the riser;

a second limb assembly including a first end and a second end, the first end of the second limb assembly is connected to the second end of the riser;

a first rotating body connected to the second end of the first limb assembly, the first rotating body including a first bow string track;

a second rotating body connected to the second end of the second limb assembly, the second rotating body including a second bow string track;

a bow string connected between the first bow string track and the second bow string track;

a first cable including a first end and a second end, the first end being split into a first yoke end and a second yoke end, the first and second yoke ends being connected to the first rotating body on a first and a second side of the first bow string track; and a first cable splitter including an anchor head portion and a spreader body portion engaged between the first yoke end and the second yoke end of the first cable, the first cable splitter further including a neck portion that connects the anchor head portion and the spreader body portion, wherein the first yoke end and the second yoke end cross over each other at the neck portion.

2. The bow of claim 1, wherein the bow is a compound bow and wherein the riser includes a handle.

3. The bow of claim 1, wherein the anchor head portion has a teardrop shaped periphery edge profile, wherein the periphery edge includes a groove, and wherein the first yoke end and the second yoke end are seated in the groove.

4. The bow of claim 1, wherein the first bow string track is non-concentric.

5. The bow of claim 1, wherein the first yoke end and the second yoke end of the first cable are configured to engage a first and second yoke tracks on the first rotating body, wherein the first and second yoke tracks are non-concentric.

6. The bow of claim 1, wherein the second end of the first cable is connected to the second rotating body, the second end of the first cable is configured to engage a first cable track on the second rotating body, wherein the first cable track is non-concentric.

7. The bow of claim 1, further comprising:

a second cable including a first end and a second end, the first end being split into a first yoke end and a second yoke end, the first and second yoke ends being connected to the second rotating body on a first and a second side of the second bow string track;

a second cable splitter including an anchor head portion and a spreader body portion engaged between the first yoke end and the second yoke end of the second cable;

wherein the first yoke end and the second yoke end of the second cable are configured to engage a first and second yoke tracks on the second rotating body, wherein the first and second yoke tracks are non-concentric; and wherein the second end of the second cable is connected to the first rotating body, the second end of the second cable is configured to engage a second cable track on the first rotating body, wherein the second cable track is non-concentric.

8. The bow of claim 1, wherein the first cable includes a plurality of strands encased in a serving, the serving terminates at a yoke junction at which the first and second yoke ends split, wherein the anchor head portion is driven against the split junction.

9. An archery cable splitter comprising:

an anchor head portion, the anchor head portion includes an anchor periphery groove in a first plane;

a spreader body portion, the spreader body portion includes a spreader periphery groove in a second plane, the second plane being coincident with the first plane; and a neck portion that connects the anchor head portion and the spreader body portion, wherein the neck portion defines a yoke receiving gap between the anchor head portion and the spreader body portion.

10. The archery cable splitter of claim 9, wherein the anchor head portion has a teardrop shaped periphery edge profile.

11. The archery cable splitter of claim 9, wherein the spreader body portion has a U-shaped periphery edge profile.

12. The archery cable splitter of claim 9, wherein the radius of curvature of the anchor periphery groove at the pointed end is between 0.005 and 0.100 inches.

13. The archery cable splitter of claim 9, wherein the radius of curvature of a base portion of a teardrop profile of the anchor head portion is between 0.125 and 0.25 inches.

14. The archery cable splitter of claim 9, wherein the anchor head portion includes a tapered end that includes a wedge angle of between 25 and 45 degrees.

15. The archery cable splitter of claim 9, wherein a tangent line that extends from the anchor periphery groove to the spreader periphery groove defines a longitudinal cable splitter bisecting line that defines a yoke transition angle, the yoke transition angle being between 90 and 120 degrees.

16. An archery cable splitter comprising:

an anchor head portion, the anchor head portion including an anchor periphery groove;

a spreader body portion, the spreader body portion including a spreader periphery groove; and a neck portion that connects the anchor head portion and the spreader body portion, the neck portion being configured to allow a first yoke end and a second yoke end of a power cable to cross over each other at the neck portion.

* * * * *